US010881180B2

(12) United States Patent
Robinson

(10) Patent No.: US 10,881,180 B2
(45) Date of Patent: Jan. 5, 2021

(54) LOW IMPACT ACCESSORY ORGANIZER

(71) Applicant: Amanda Robinson, Leesburg, FL (US)

(72) Inventor: Amanda Robinson, Leesburg, FL (US)

( * ) Notice: Subject to any disclaimer, the term of this patent is extended or adjusted under 35 U.S.C. 154(b) by 50 days.

(21) Appl. No.: 16/209,532

(22) Filed: Dec. 4, 2018

(65) Prior Publication Data

US 2019/0166965 A1 Jun. 6, 2019

Related U.S. Application Data

(60) Provisional application No. 62/594,785, filed on Dec. 5, 2017.

(51) Int. Cl.

| | |
|---|---|
| ***A45C 11/16*** | (2006.01) |
| ***A47G 25/14*** | (2006.01) |
| ***A47F 7/02*** | (2006.01) |
| ***A47G 25/10*** | (2006.01) |
| ***A47G 25/06*** | (2006.01) |

(52) U.S. Cl.

CPC ..... *A45C 11/16* (2013.01); *A47F 7/02* (2013.01); *A47G 25/0607* (2013.01); *A47G 25/10* (2013.01); *A47G 25/1407* (2013.01); *A47G 25/1414* (2013.01); *A45C 2200/10* (2013.01)

(58) Field of Classification Search

CPC ..... A45C 11/16; A45C 2200/10; A47F 7/02; A47F 7/022; A47F 7/14; A47F 7/143; A47F 5/0876; A47F 5/0807; A47F 5/0006; A47G 25/0607; A47G 25/10; A47G 25/1407; A47G 25/1414; A47G 29/087; A47G 29/10

USPC ..... 211/106.01, 85.2, 85.5, 85.9; 206/6.1

See application file for complete search history.

(56) References Cited

U.S. PATENT DOCUMENTS

| | | | | | |
|---|---|---|---|---|---|
| 1,525,748 | A | * | 2/1925 | Klein | D05B 91/14 242/134 |
| 1,716,863 | A | * | 6/1929 | Morris | A47J 47/16 211/41.1 |
| 1,801,058 | A | * | 4/1931 | Sutcliffe | A47F 5/02 211/163 |
| 2,813,622 | A | * | 11/1957 | Lancellotti | A47F 7/03 206/6.1 |
| 3,769,741 | A | * | 11/1973 | Hessler | A01K 97/06 43/57.1 |
| 3,858,718 | A | * | 1/1975 | Roy | A45C 11/16 206/457 |
| 4,120,401 | A | * | 10/1978 | Newman | A45C 11/16 206/566 |
| 4,181,224 | A | * | 1/1980 | Aber | A47F 7/02 206/486 |
| 4,264,013 | A | * | 4/1981 | Vollmer | A47G 29/08 211/85.2 |

(Continued)

*Primary Examiner* — Jennifer E. Novosad

(74) *Attorney, Agent, or Firm* — Jason T. Daniel, Esq.; Daniel Law Offices, P.A.

(57) ABSTRACT

An accessory organizer device includes an elongated main body having a plurality of surfaces. A plurality of hooks is secured along one or more surfaces of the main body and can function to engage any number of secondary items such as clothing, jewelry, hats and glasses. The main body includes a layered construction having a rigid core, a padded layer, a decorative layer and a transparent layer. An outer layer is removably secured to the main body and includes a plurality of grommets that are shaped and sized to receive the plurality of hooks.

12 Claims, 4 Drawing Sheets

(56) References Cited

U.S. PATENT DOCUMENTS 4,304,382 A * 12/1981 Jelen ..... B25H 3/04 211/89.01
4,324,446 A * 4/1982 LeSage ..... A45C 11/16 206/566
4,413,736 A * 11/1983 Nibling ..... A47F 7/02 206/457
4,485,929 A * 12/1984 Betts, Sr. ..... B01L 9/00 211/59.1
4,687,103 A * 8/1987 Corbett ..... A47G 1/12 206/489
4,787,516 A * 11/1988 Morrison ..... A47F 7/02 206/205
4,923,069 A * 5/1990 Germain ..... A45C 11/16 206/495
5,009,333 A * 4/1991 Souders ..... A45C 11/16 211/85.2
5,054,624 A * 10/1991 Camp ..... A47F 5/02 211/163
5,141,300 A * 8/1992 Ciesla ..... A47B 9/00 206/566
5,168,986 A * 12/1992 Stenhouse ..... A47F 7/02 206/45.24
5,425,444 A * 6/1995 Chapman ..... A47F 7/02 206/348
D393,542 S * 4/1998 Thompson ..... D3/294
D412,063 S * 7/1999 Thompson ..... D3/319
5,921,407 A * 7/1999 Kabanek ..... A61B 50/20 211/65
D413,472 S * 9/1999 Dagan ..... D18/6
D418,347 S * 1/2000 Dragonette ..... D6/559
6,193,066 B1 * 2/2001 Kilmartin, III ..... A45C 11/16 206/495
6,247,584 B1 * 6/2001 Au ..... A45C 11/10 190/124
6,371,285 B1 * 4/2002 DuBois ..... A47G 29/08 206/6.1
6,450,595 B1 * 9/2002 Simon ..... A45C 11/16 206/6.1
6,471,053 B1 * 10/2002 Feibelman ..... A47F 7/02 206/495
7,175,019 B2 * 2/2007 Beal ..... A45C 11/16 206/6.1
7,207,635 B2 * 4/2007 Simmons ..... A47F 3/002 206/6.1
D542,536 S * 5/2007 Gialanella ..... D3/315
7,731,023 B1 * 6/2010 Lesch ..... A47G 1/12 190/101
7,806,255 B1 * 10/2010 Staver ..... A45C 11/16 206/6.1
8,047,851 B1 * 11/2011 Baxter ..... B43K 23/001 434/408
8,070,025 B1 * 12/2011 Nelson ..... A47G 25/14 211/85.2
8,151,980 B2 * 4/2012 DeMartino ..... A47G 29/08 206/495
8,348,054 B2 * 1/2013 Dragan ..... A45C 13/03 206/287
8,657,124 B2 * 2/2014 Brown ..... A47G 29/00 211/113
9,271,585 B1 * 3/2016 Chung ..... A47F 7/021
9,332,820 B2 * 5/2016 Bernard ..... A45D 44/02
9,491,995 B1 * 11/2016 Sichi ..... A45C 11/16
D789,707 S * 6/2017 Porisky ..... D6/569
D871,808 S * 1/2020 Thompson ..... D6/680.2
2006/0180481 A1 * 8/2006 McGaughey, Sr. ..... A47F 7/03 206/6.1
2009/0194650 A1 * 8/2009 Corvo ..... A47G 1/02 248/205.3
2012/0138555 A1 * 6/2012 Ward ..... A45C 11/16 211/85.2
2014/0263116 A1 * 9/2014 Wojciechowski .... A47F 5/0807 211/85.2
2015/0068993 A1 * 3/2015 Ye ..... A45C 13/123 211/85.2
2019/0166965 A1 * 6/2019 Robinson ..... A45C 11/16

* cited by examiner

LOW IMPACT ACCESSORY ORGANIZER

CROSS-REFERENCE TO RELATED APPLICATIONS

This application claims the benefit of U.S. Application Ser. No. 62/594,785 filed on 5 Dec. 2017, the contents of which are incorporated herein by reference.

TECHNICAL FIELD

The present invention relates generally to storage and organization devices, and more particularly to a low impact accessory organizer.

BACKGROUND

The statements in this section merely provide background information related to the present disclosure and may not constitute prior art.

Accessory organizers have traditionally been constructed to receive and hold particular items, such as hats, for example. In this regard, most organizers are constructed from rigid materials such as wood, for example, and include a plurality of hooks or clamps that are fixedly positioned along the wood backing at predetermined locations suitable for receiving hats or other such articles.

Although these devices may be suitable for this limited use, their fixed design does not allow them to adequately hold and/or display other types of items. Additionally, the rigid construction materials used in the construction of such organizers is not suitable for use with delicate items such as jewelry or sunglasses, for example. Moreover, there is no way for a user to customize the look of these devices, thus making them unsuitable for children whose likes and interests change regularly.

Accordingly, it would be beneficial to provide a low impact accessory organizer having a padded backing, a plurality of removable clips, and decorative elements that can be changed at will, so as to overcome the drawbacks described above.

SUMMARY OF THE INVENTION

The present invention is directed to an accessory organizer device. One embodiment of the present invention can include an elongated main body having any number of different shapes and sizes. A plurality of hooks can be secured along one or more surfaces of the main body and can function to engage any number of secondary items such as clothing, jewelry, hats and glasses, for example.

One embodiment of the device can include a layered construction having a rigid core, a padded layer, a decorative layer and a transparent layer.

One embodiment of the device can include a removable outer layer having a plurality of grommets that are shaped and sized to receive the plurality of hooks.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
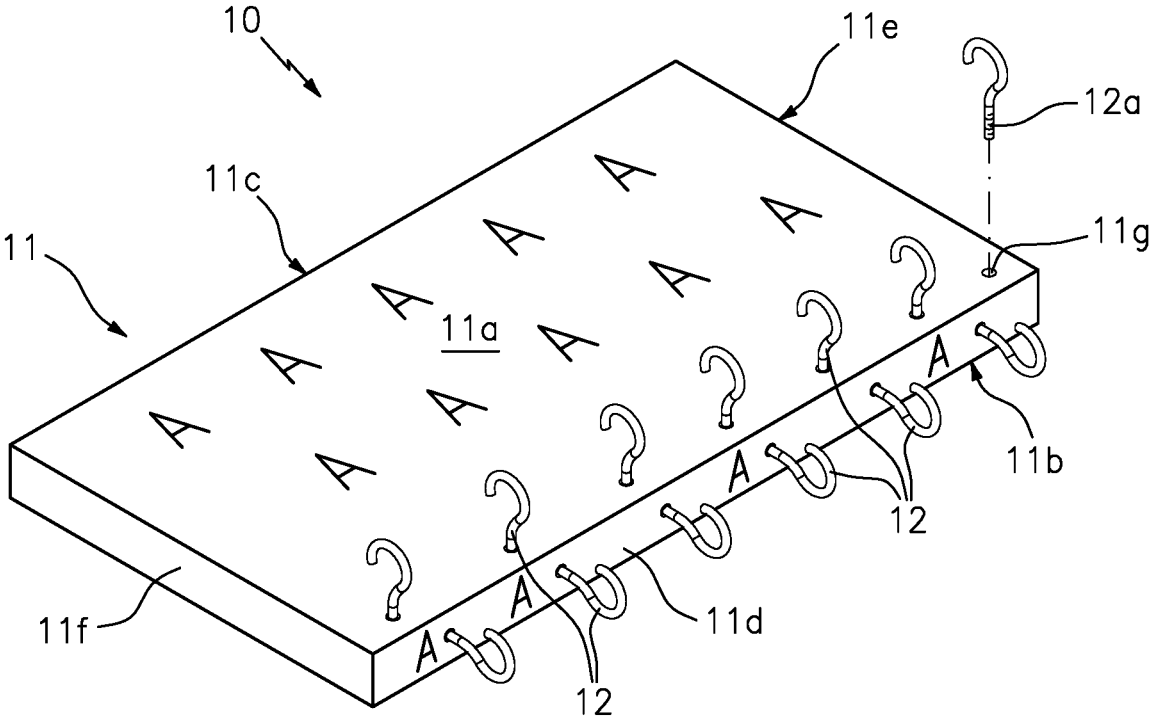
FIG. 1 is a perspective view of the low impact accessory organizer device that is useful for understanding the inventive concepts disclosed herein.
Figure 2:
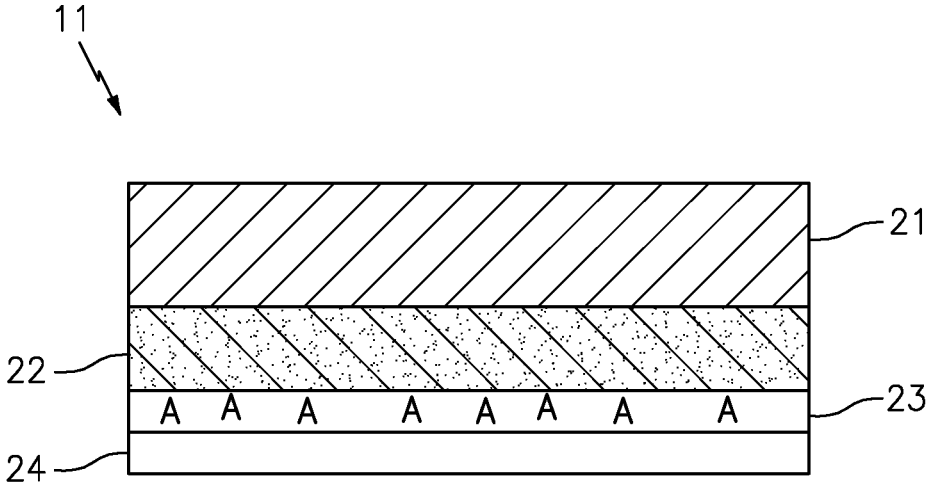
FIG. 2 is a partial cutout cross section view of a layered construction of the main body of the low impact accessory organizer device, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described throughout this document, the term "complementary shape," and "complementary dimension," shall be used to describe a shape and size of a component that is identical to, or substantially identical to the shape and size of another identified component.

As described herein, the term "removably secured" and derivatives thereof shall be used to describe a situation wherein two or more objects are joined together in a non-permanent manner to allow the same objects to be repeatedly joined and separated. This can be accomplished through the use of any number of commercially available connectors such as opposing strips of hook and loop material (i.e. Velcro®), magnets, and/or compression fittings such as locking pins, clamps, nut/bolts, tethers (e.g., zip ties), snaps and buttons, for example.

Moreover, the term "permanently secured" shall be used to describe a situation wherein two or more objects are joined together in a manner so as to prevent the same objects from being separated. Several nonlimiting examples include various adhesives such as glue or resin, hardware such as nuts and bolts, and welds, for example.

FIGS. 1-4 illustrate various embodiments of a low impact accessory organizer 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown best in FIG. 1, the main body 11 can include an elongated member having a front surface 11*a*, a back surface

11*b*, a top surface 11*c*, a bottom surface 11*d*, and a pair of side surfaces 11*e* and 11*f*. Although illustrated with regard to a rectangular shape, this is for illustrative purposes only, as the main body can include any number of different shapes and sizes as may be suitable for use in any environment, such as a home office, classroom, or child's bedroom, for example. As such, the main body can include ordinary shapes such as a square, a rectangle or an oval, for example, or can include fanciful shapes such as a star, an animal, or a character, for example.

In either instance, a plurality of hooks 12 can be secured along one or more surfaces of the main body 11. In one embodiment, each of the hooks can be constructed from a resilient material such as rubber coated wire, for example, having a soft outer surface that will not scratch delicate materials such as jewelry or glass. In the preferred embodiment, each of the hooks can include a threaded end 12*a* that can engage pre-drilled apertures 11*g* along the main body so as to be removably secured therein via a twisting motion. Such a feature allows a user to customize the location of the hooks to suit any type/number of objects to be suspended from the organizer.

Although described as including hooks having a particular shape and construction material, this is for illustrative purposes only. To this end, those of skill in the art will recognize that the hooks can include any number of different shapes, sizes and/or construction materials capable of being removably or permanently secured to the main body and engaging any secondary object.

In the preferred embodiment, the main body 11 can include a layered construction, wherein each layer performs a different and specific function. As illustrated in cross sectional FIG. 2, the main body 11 can preferably include a rigid core 21, a padded layer 22, a decorative layer 23 and a transparent layer 24.

The core 21 can provide and maintain the overall shape of the main body 11, while also providing the structural support for the remaining device components. To this end, the core 21 may be formed from materials that are, for example, relatively strong and stiff for their weight. Several nonlimiting examples include, but are not limited to materials such as wood, molded plastic, or PVC, for example. The rigid core can also include one or more wall engagement members (not illustrated) such as sawtooth picture frame hangers or d-ring picture hangers along the rear facing surface, so as to allow the device to be suspended from a wall or other such location.

The padded layer 22 can be disposed along one or more of the front, top, bottom, and side surfaces of the core 21. In the preferred embodiment, the padded layer can include or comprise a cushioning material, such as Styrofoam, high density foam, high resilience foam, Polyurethane, memory foam, closed cell foam, and/or open cell foam, for example. As will be described below, the padded layer can function to provide a soft surface that resists impact with objects being engaged by the hooks. The padded layer can be secured onto the core in accordance with known construction methodologies such as various adhesives, double sided tape, or staples, for example.

The decorative layer 23 can preferably be constructed from a fanciful fabric material having an unlimited number of decorative elements A thereon. In one embodiment, the decorative layer can be stretched over the padded layer and wrapped around to the back side of the core where it can be secured in either a permanent manner via staples or glue, or in a removable manner via strips of hook and loop material, for example.

As described herein, the term "decorative elements" can include any number and type of different colors, markings, words, shapes, symbols, logos, designs, types of materials, texturing of materials, patterns, images, lithographs, photographs and/or jewels, for example. These elements can be secured onto and/or into the identified portion of the device main body in accordance with known techniques to be flush with the surface thereof or can be recessed, raised and/or protruding outward therefrom, so as to give a three-dimensional effect.

The transparent layer 24 can function to cover and protect the decorative layer 23 while allowing the decorative elements to remain visible. To this end, the transparent layer will preferably be constructed from vinyl or other such material that is both waterproof and can receive markings from a dry erase marker. Such a feature allows the end user to write any number of messages along the device body, and to erase the same without damaging the decorative layer. In one embodiment, the transparent layer can be stretched over the decorative layer and wrapped around to the back side of the core where it can be secured in either a permanent manner via staples or glue, or in a removable manner via strips of hook and loop material, for example.

Figure 3:
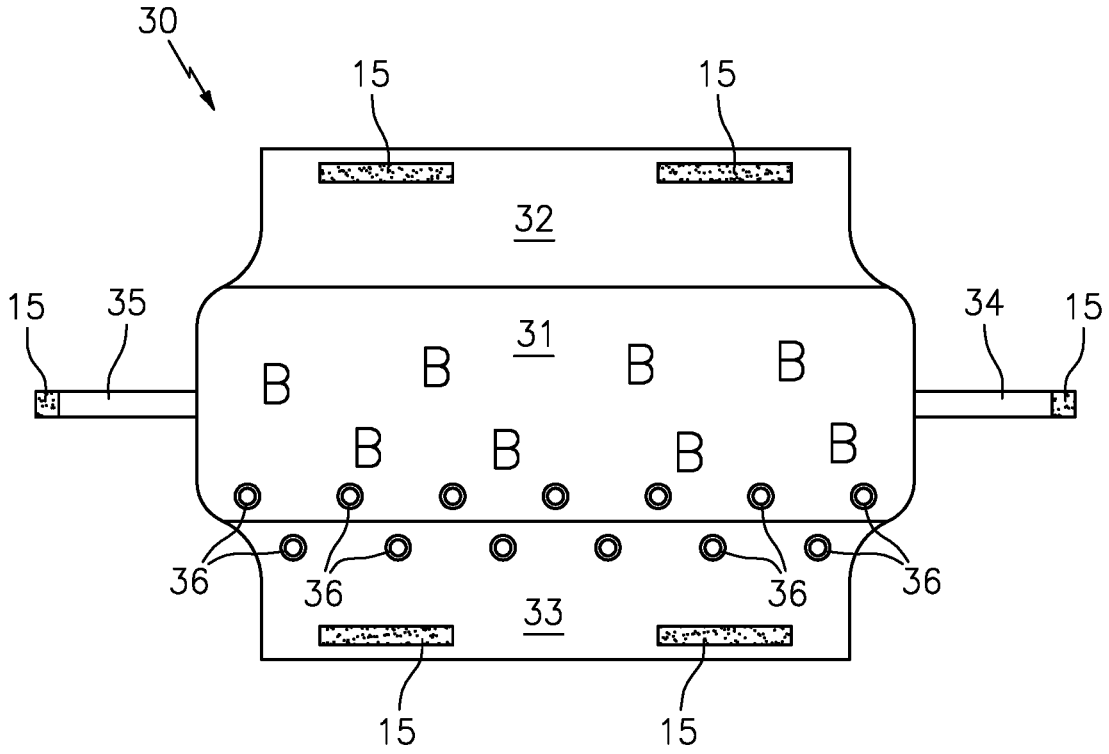
FIG. 3 is a front view of a removable cover of the low impact accessory organizer device, in accordance with one embodiment of the invention.
Figure 4:
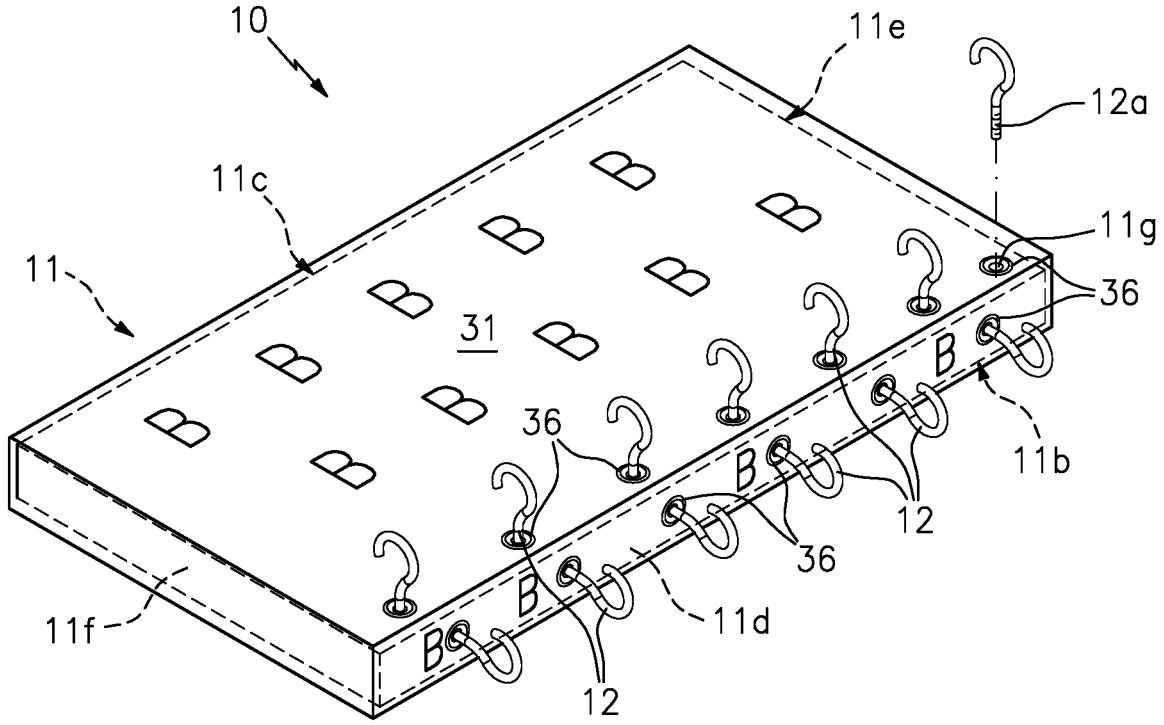
FIG. 4 is another perspective view of the low impact accessory organizer device, in accordance with one embodiment of the invention.

As shown in FIGS. 3 and 4, the device 10 can also include one or more outer layers 30 which can be removably secured onto the main body 11. These outer layer(s) can be constructed from any number of different materials such as various fabrics and can also be provided with any number of additional decorative elements B so as to allow the end user to change the overall look of the device at will.

In one embodiment, the outer layer can include a functional construction. For example, one embodiment of the outer layer can be constructed from an ultra-soft silk or satin material and/or can be embedded with a non-tarnish spray coating, for example, so as to act as a cleaning surface for glasses or jewelry. In this regard, during a cleaning process the padded layer can protect the glasses or jewelry from becoming damaged, while the soft outer layer polishes the jewelry or glasses lens to a shine. Finally, the cleaned accessory can be suspended from one of the hooks 12

In one embodiment, the outer layer 30 can include an elongated central body section 31 having a shape and size that is complementary to the front surface, top surface, bottom surface, and side surfaces of the main body 11 to cover an entirety thereof. The outer layer can include protruding upper and lower body segments 32 and 33 each having hook and loop connectors 15 which engage together along the back end of the main body. Likewise, protruding side segments 34 and 35 also include hook and loop connectors 15 which engage together along the back side of the main body.

As shown, a plurality of grommets 36 are positioned along the decorative layer 30 at locations complementary to the locations of the hooks 12. Each of the grommets including a size that is suitable for receiving a single hook, to allow the decorative cover 30 to be removably positioned over the main body without having to remove the hooks 12. Although not illustrated above, it is noted that the removable variants of the decorative layer 23 and transparent layer 24 can include an identical construction as the outer layer 30.

Accordingly, the above described low impact accessory organizer device 10 can function to allow a user to store any number of different accessories while customizing the look and location of the hanging hooks at will.

As described herein, one or more elements of the device 10 can be secured together utilizing any number of known attachments means such as, for example, screws, glue, and compression fittings, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An accessory organizer device, comprising:

an elongated main body having a front surface, a back surface, a top surface, a bottom surface, a pair of side surfaces and a plurality of apertures located along the main body;

said main body having a layered construction that includes a rigid core layer, a padded layer, a decorative layer having a first plurality of decorative elements, and a transparent layer that is positioned over the first decorative layer;

a plurality of hooks that are removably secured to the plurality of apertures located along the main body;

an outer layer that is removably secured over the main body, said outer layer having a second plurality of decorative elements; and a plurality of openings that are positioned along the outer layer, each of said openings being positioned at a complementary location to one of the plurality of apertures located along the main body, wherein the transparent layer is waterproof and is configured to receive non-permanent markings from a dry erase marker.

2. The device of claim 1, wherein the rigid core layer is constructed from at least one of plastic or wood.

3. The device of claim 1, wherein the padded layer that is secured along a front portion of the rigid core layer.

4. The device of claim 3, wherein the padded layer is constructed from at least one of Styrofoam, high density foam, high resilience foam, Polyurethane, memory foam, closed cell foam, or open cell foam.

5. The device of claim 1, wherein the decorative layer is secured over an entirety of the rigid core layer and the padded layer.

6. The device of claim 5, wherein the decorative layer is constructed from fabric.

7. The device of claim 1, wherein the transparent layer is secured over an entirety of the decorative layer.

8. The device of claim 7, wherein the transparent layer is constructed from vinyl.

9. The device of claim 1, wherein each of the decorative layer and the transparent layers is removably secured onto the rigid core layer.

10. The device of claim 1, wherein the outer layer is constructed from satin or silk.

11. The device of claim 1, wherein the outer layer is coated with a non-tarnish material and is configured to polish an item suspended from one of the plurality of hooks.

12. An accessory organizer device, consisting of:

an elongated main body having a front surface, a back surface, a top surface, a bottom surface, a pair of side surfaces and a plurality of apertures located along the main body;

said main body having a layered construction that includes a rigid core layer, a padded layer, a decorative layer having a first plurality of decorative elements, and a waterproof transparent layer that is positioned over the first decorative layer;

a plurality of hooks that are removably secured to the plurality of apertures located along the main body;

an outer layer that is removably secured over the main body, said outer layer having a second plurality of decorative elements; and a plurality of openings that are positioned along the outer layer, each of said openings being positioned at a complementary location to one of the plurality of apertures located along the main body.

* * * * *